US010584464B2

(12) United States Patent
Armstrong

(10) Patent No.: US 10,584,464 B2
(45) Date of Patent: Mar. 10, 2020

(54) BOX BLADE EARTH GRADING IMPLEMENT

(71) Applicant: John V. Armstrong, Rose Hill, KS (US)

(72) Inventor: John V. Armstrong, Rose Hill, KS (US)

( * ) Notice: Subject to any disclaimer, the term of this patent is extended or adjusted under 35 U.S.C. 154(b) by 0 days.

(21) Appl. No.: 16/156,308

(22) Filed: Oct. 10, 2018

(65) Prior Publication Data

US 2019/0040606 A1 Feb. 7, 2019

(51) Int. Cl.
*E02F 3/815* (2006.01)
*E02F 3/76* (2006.01)

(52) U.S. Cl.
CPC ..... *E02F 3/8157* (2013.01); *E02F 3/7622* (2013.01); *E02F 3/7627* (2013.01); *E02F 3/7672* (2013.01)

(58) Field of Classification Search
CPC ..... E02F 3/8157; E02F 3/7627
See application file for complete search history.

(56) References Cited

U.S. PATENT DOCUMENTS

| | | | | |
|---|---|---|---|---|
| 2,321,833 | A | 6/1943 | Lull | |
| 2,959,876 | A | 11/1960 | Lull | |
| 3,191,324 | A | 6/1965 | Beyers et al. | |
| 3,486,254 | A | 12/1969 | Campbell | |
| 3,770,065 | A | 11/1973 | Gill | |
| 3,791,452 | A | 2/1974 | Long et al. | |
| 4,329,081 | A | 5/1982 | Buvik | |
| 4,389,800 | A | 6/1983 | Goby | |
| 4,871,025 | A | 10/1989 | Mayfield et al. | |
| 5,307,570 | A | 5/1994 | Brown | |
| 5,344,254 | A | 9/1994 | Sartain | |
| 5,819,444 | A * | 10/1998 | Desmarais | E01H 5/06 37/281 |
| 6,238,136 | B1 * | 5/2001 | Sovik | E01C 19/48 404/118 |
| 6,308,785 | B1 | 10/2001 | Rhoden | |
| 6,328,115 | B1 | 12/2001 | Carter, Jr. | |
| 6,352,126 | B1 | 3/2002 | Brown | |
| 7,686,537 | B2 | 3/2010 | Mullett | |

(Continued)

FOREIGN PATENT DOCUMENTS

| | | |
|---|---|---|
| DE | 201310103642 | 2/2018 |
| GB | 593967 | 10/1947 |
| GB | 727806 | 4/1955 |

*Primary Examiner* — Tara Mayo-Pinnock
(74) *Attorney, Agent, or Firm* — Kenneth H. Jack; Davis & Jack, L.L.C.

(57) ABSTRACT

A box blade earth grading implement incorporating a blade; a left wall having upper and lower segments, the lower segment having a lower end, and the upper segment being attached to the left end of the blade; a right wall having upper and lower segments, the lower segment having a lower end, and the upper segment being attached to the right end of the blade; left and right skid plates attached to the lower ends of the lower wall segments; left and right hydraulic cylinders having left and right upper mounts attaching to the walls' upper segments; left and right pivot mounts attaching the lower ends of the left and right hydraulic cylinders to the left and right skid plates; and a towing tongue extending forwardly from the blade.

12 Claims, 5 Drawing Sheets

(56) References Cited

U.S. PATENT DOCUMENTS

| | | | | |
|---|---|---|---|---|
| 7,909,534 | B1 * | 3/2011 | Comer | E01C 19/42<br>404/118 |
| 9,243,376 | B2 | 1/2016 | Guggino et al. | |
| 9,290,892 | B2 * | 3/2016 | Vaske | E01C 19/42 |
| 2008/0217036 | A1 | 9/2008 | Miskin | |
| 2010/0326684 | A1 | 12/2010 | Mullett | |

* cited by examiner

BOX BLADE EARTH GRADING IMPLEMENT

FIELD OF THE INVENTION

This invention relates to earth working tools which are attachable as auxiliary implements to self propelled construction and agricultural vehicles such as tractors, front loader tractors, and skid steer loaders. More particularly, this invention relates to auxiliary box blade earth grading implements.

BACKGROUND OF THE INVENTION

Earth working box blade implements commonly form a partially enclosed rigid box frame which includes left and right sidewalls and an earth screeding or scraping blade which spans laterally between such walls. Such implements are commonly pulled by forwardly extending towing tongue behind a tractor. Alternatively, box blades are known to be mounted to the rear of a tractor upon the tractor's three point hitch arms. Further alternatively, box blades graders may be adapted for attachment to the lift arms of a front end loader or skid steer loader vehicle.

Such conventional box blade earth grading implements commonly lack any capability or capacity for raising and lowering the blade in relation to ground level. Also, they commonly lack any capability of adjusting the angle or lateral tilt of the blade with respect to the level of a ground surface to be graded. In the event that such conventional box blade implements encounter or are driven against a protrusion such as a rock, the box blade commonly becomes undesirably laterally tilted, temporarily interrupting and interfering with the smooth progress of earth grading.

The instant inventive box blade earth grading implement solves or ameliorates the problems, defects, and challenges of conventional box blades discussed above by specially configuring the box's left and right walls to include extendable and retractable segments, by applying linear motion actuators to effect such extensions and retractions, and by associating pivot joints with the each of the walls' lower segments.

BRIEF SUMMARY OF THE INVENTION

A first structural component of the instant inventive box blade earth grading implement comprises a heavy steel blade having a laterally extending earth cutting or screeding lower edge. In the preferred embodiment, removable and replaceable high carbon steel cutter plates are attached in a lateral series along the lower edge of the blade component. In such embodiment, the blade's lower edge effectively comprises such plates' lower cutting edges.

Further structural components of the instant inventive box blade comprise left and right steel walls, each such wall comprising an upper segment and a lower segment. In the preferred embodiment, the upper segments of such left and right walls are respectively fixedly welded to the left and right ends of the blade. The left and right walls' lower segments preferably overlap and outwardly overlie such walls' upper segments. The left and right lower wall segments respectively have attached left and right skid plates which extend in the front to rear or longitudinal direction along such walls' lower edges.

Further structural components of the inventive box blade comprise left and right linear motion actuators which are attached to and span vertically between the upper segments of the left and right walls and the lower segments of such walls. In a preferred embodiment, the left and right linear motion actuators comprise two way hydraulic cylinders which are mounted vertically extending and retracting the left and rights walls' lower segments and their attached skid plates. Suitably, such actuators may alternatively comprise pneumatic cylinders, jack screw actuators, ball screw actuators, or rack and pinion gear actuators. Left and right upper mounts are preferably provided for rigidly positioning the upper ends of the left and right linear motion actuators at positions overlying the wall's left and right lower segments. In a preferred embodiment, the left and right upper mounts comprise pin, eye, and clevis mounts which anchor the actuators upon the upper wall segments.

Further structural components of the inventive box blade comprise left and right pivot mounts which operatively connect the lower ends of the left and right linear motion actuators with the left and right lower wall segments and with their left and right skid plates. Suitably, the left and right pivot mounts may attach either to the walls' lower segments or to upper surfaces of their skid plates. Such mounts preferably comprise pivot facilitating pivoting pin, eye and clevis joints.

The inventive box blade preferably further comprises propelling means which are adapted for allowing the box structure to be either pulled or pushed over a ground surface to be shaped and graded by the implement. A preferred propelling means assembly comprises a forwardly extending towing tongue whose forward end is adapted for engagement with a truck or tractor's rear end tow hitch. Where the propelling means comprise such towing tongue assembly, downwardly extendable and upwardly retractable trailering wheels are preferably mechanically associated and positioned to the rear of the box blade. Such extendable and retractable wheels advantageously allow the implement to drop accumulated earth from the box space, and to raise the box above the ground to allow towing of the implement in the manner of a rollable trailer.

Suitably, the propelling means may alternatively comprise pivoting attachment points which are adapted for connection with a tractor or vehicle's front end or rear end auxiliary implement pivot bar linkage. Such linkage may comprise a Ferguson type three point hitch or other parallel bar linkage actuated by a hydraulic cylinder of motorized jack screw. Further alternatively, the propelling means may comprise mounts for attachment to the lift arms and bucket dumping rams of a front loader tractor vehicle or a skid steer loader vehicle. To facilitate such attachment, a rear surface of the box may be adapted for engagement with a skid steer quick attach system.

In operation of the instant inventive box blade earth grading implement, the left and right linear motion actuators may be selectively actuated to set the blade at a desired height with respect to a ground surface to be graded, and to adjust the angle of the blade over the ground. For example, upon raising the left side of the blade slightly higher than the right side of the blade, and upon forwardly propelling the implement along the right side of a dirt or gravel road, the implement may advantageously smoothly grade the road to include an appropriately sloped crown.

In the event that the left or right skid plate strikes against an obstruction, such as a rock, during such forward propulsion, the pivoting mounts of the left and right walls' lower segments and skid plates advantageously allow the obstructed skid plate to pivot or pitch upwardly, and then counter-pivot downwardly over the obstruction. Accordingly, the inventive implement allows the skid plates and their attached wall lower segments to "walk" over obstructions encountered during grading. The facilitated walking action of the skid plates advantageously minimizes disruptions of the pre-set lateral orientation of the blade during road grading.

Accordingly, objects of the instant invention include the provision of a box blade earth grading implement which incorporates structures and components as described above, and which arranges such structures in relation to each other in the manners described above for the achievement and performance of beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENTS

Figure 1:
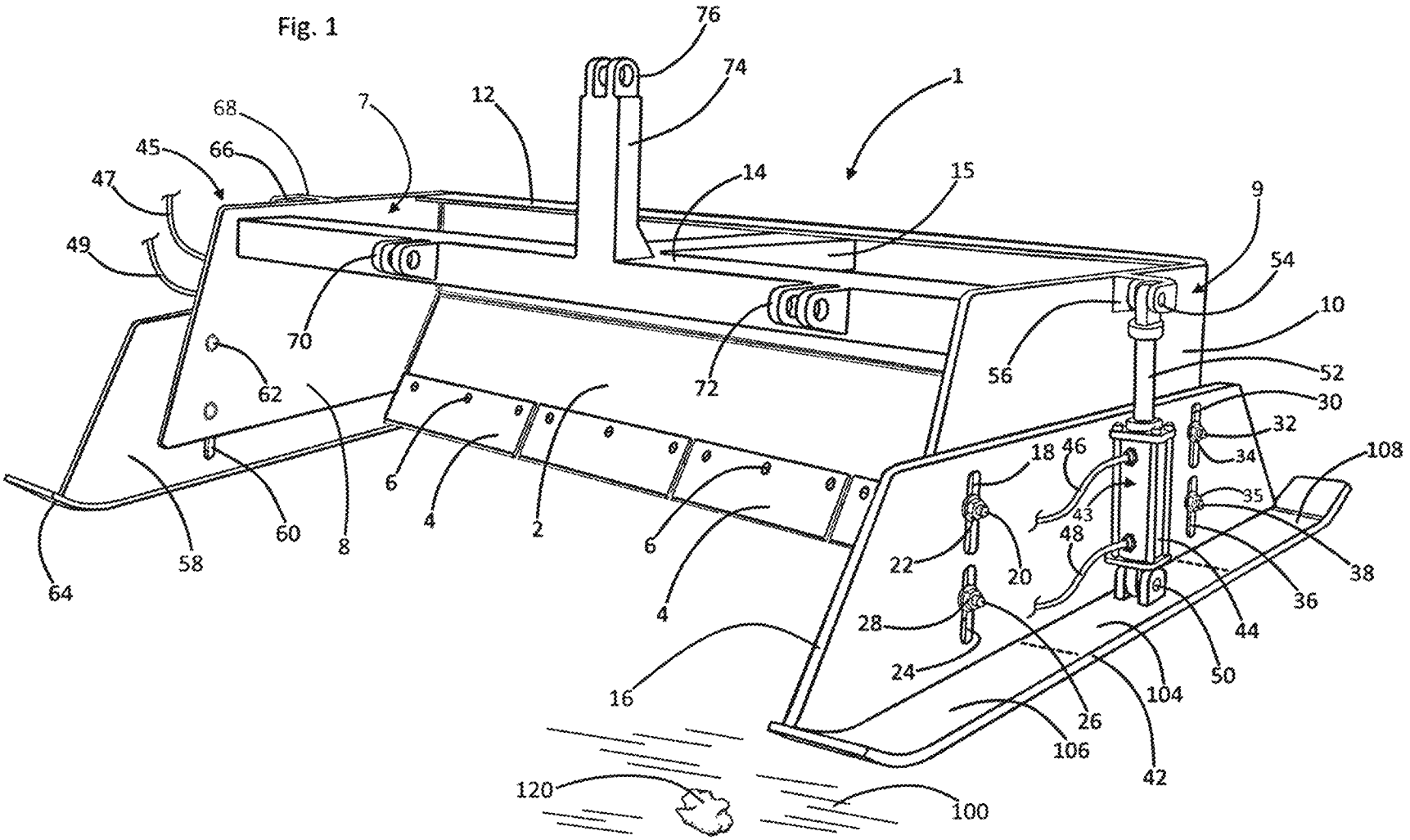
FIG. 1 is a perspective view of a preferred embodiment of the instant inventive box blade earth grading implement.

Referring now to the drawings and in particular to Drawing FIG. 1, a preferred embodiment of the instant inventive box blade earth grading implement is referred to generally by Reference Arrow 1. The implement 1 has a heavy steel blade 2 having left and right ends, the left end of the blade being closest to the viewer in Drawing FIG. 1. High carbon steel earth cutting plates 4 are preferably removably attached to the lower end of the blade 2 by means of recessed bolts 6.

A left wall component of the instant inventive assembly is referred to generally by Reference Arrow 9, such wall preferably being segmented to include an upper segment 10, and an outwardly overlapping lower segment 16. In a preferred embodiment, the upper segment 10 of the left wall 9 is rigidly welded to the left end of the blade 2.

A similarly configured right wall 7 has upper and lower segments 8 and 58, such right wall similarly being rigidly welded to the right end of blade 2. Walls 7 and 9 in combination with blade 2 effectively form right, left, and rear walls bounding an earth collecting box space. For enhancement of rigidity of such box, a reinforcement flange 12 is welded in place across the upper end of the blade 2.

To facilitate forward sliding motion of the implement 1 over a ground or earth surface 100, left and right skid plates 42 and 64 are provided, such plates being respectively fixedly welded to the lower ends of the lower wall segments 16 and 58 of the left and right walls 9 and 7. Skid plates 42 and 64 preferably have upturned leading ends to assure that the plates plane over rather than gouge into ground surfaces.

Left and right linear motion actuator components of the instant inventive assembly are referred to generally by Reference Arrows 43 and 45, the majority of actuator 45 being out of view. In a preferred embodiment, the left linear motion actuator 43 comprises a two way hydraulic cylinder 44 having dual pressure lines 46 and 48, and having an extendable and retractable piston rod 52. The assembly's right linear motion actuator 45 is preferably similarly configured, having pressure lines 47 and 49 within the view of the figure. The instant invention's linear motion actuators 43 and 45 are intended as being representative of other suitably substituted linear motion actuators such as jack screw actuators, ball screw actuators, pneumatic cylinders, and rack and pinion gear actuators.

Left and right upper mounts 54,56, and 66,68 are preferably provided for rigidly positioning and pivotally anchoring the upper ends of the linear motion actuators 43 and 45 at respective positions above or overlying the left and right walls' lower segments 16 and 58. In a preferred embodiment, such upper mounts comprise, as depicted, pivoting pin, eye, and clevis joints which attach directly to upper ends of the upper wall segments 10 and 8.

A left pivot mount 50 is preferably provided for fixedly and pivotably attaching the lower end of the left linear motion actuator 43 to the left skid plate 42. A mirroring right lower mount component is preferably similarly provided for interconnecting the lower end of the right linear motion actuator 45 with skid plate 64. As designated by dashed lines drawn upon skid plate 42, such plate has a front section 106, a medial section 104, and a rear section 108, each such section having a longitudinal length which is approximately one-third of the overall longitudinal length of the skid plate 42. In the preferred embodiment, the lower pivoting mount 50 of the left linear motion actuator 43 is positioned at and upon the skid's medial section 104 to facilitate centralized pitching and counter-pitching or pivoting and counter-pivoting motions of the skid plate 42 about pivot joint 50.

The assembly's linear motion actuator lower mounts may suitably be alternatively configured similarly with mounts 54,56, and 66,68, such alternative mounts being anchored at the lower ends of lower wall segments 16 and 58, rather than at the depicted anchoring points upon the upper flange surfaces of skid plates 42 and 64.

A further structural component of the instant inventive box blade earth grading implement 1 comprises propelling means which are fixedly attached at least to a structure selected from the group consisting of the blade 2, the left wall's upper segment 10, and the right wall's upper segment 8. As shown in FIG. 1, an example of such propelling means comprises a laterally extending brace beam 14 (whose left and right ends are fixedly welded to wall segments 10 and 8), in combination with a rearwardly extending "T" column 15 (whose rearward end is anchored upon blade 2).

Figure 2:
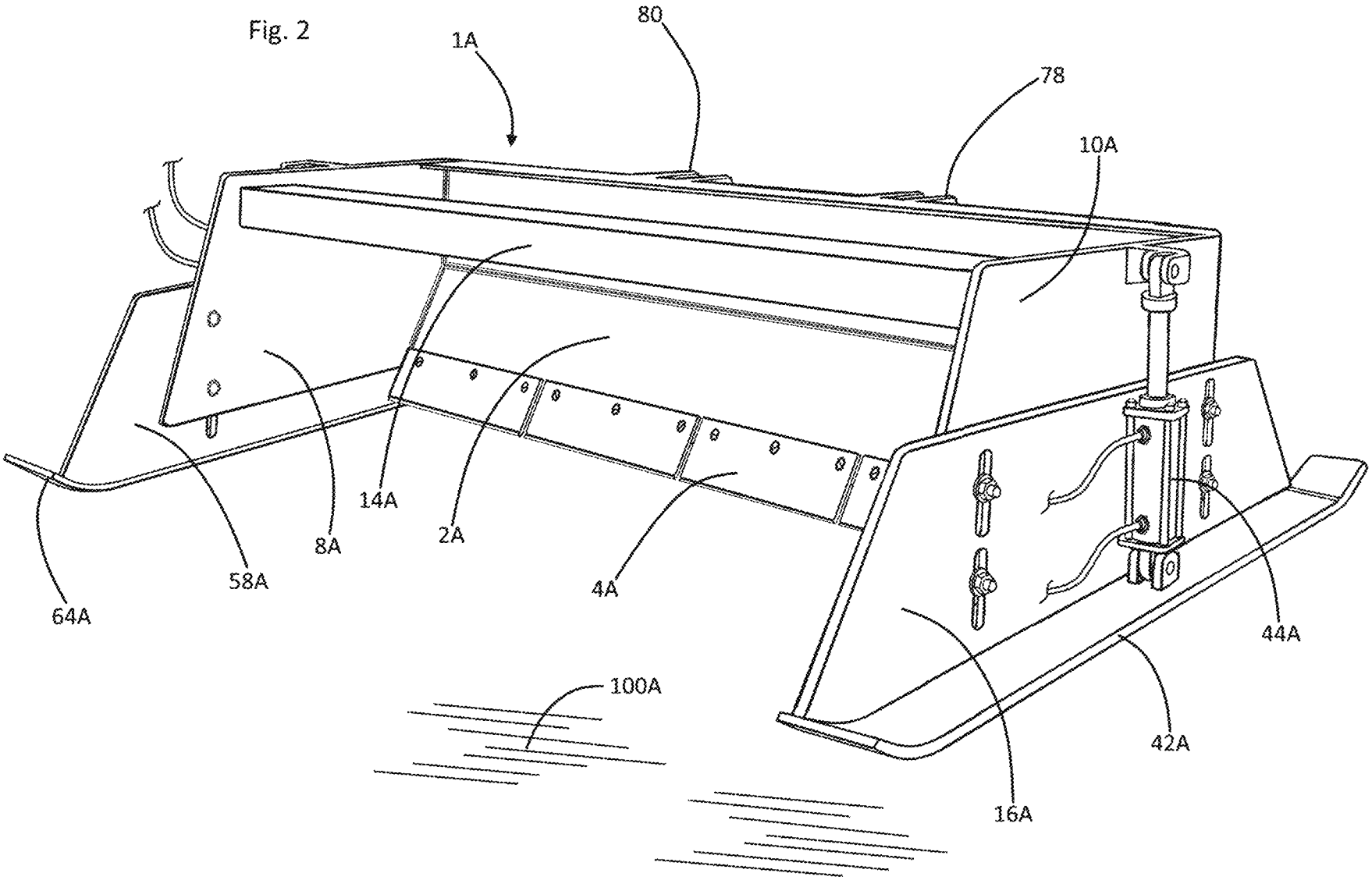
FIG. 2 presents an alternative configuration of the implement of FIG. 1.

In the exemplary propelling means of FIG. 1, a center column 74 having an upper clevis mount 76 is provided for a suitable attachment to a center pivot arm of a tractor's rear Ferguson type three point hitch (not depicted within views). Such propelling means further provides left and right clevis mounts 72 and 70 which may attach to the pivoting left and right lift arms of such three point hitch. Such mounts 70,72,76 may alternatively facilitate attachments to other types of vehicle auxiliary implement pivot arm linkages, such as a hydraulic or jack screw actuated parallel bar linkage. Where FIG. 1's mounts 70,72,75 are used for attachment to the pivot arms of a three point hitch, the implement 1 may be conveniently mounted as an auxiliary implement at the rear of a common agricultural tractor. Referring to FIG. 2, an alternatively configured box blade earth grading implement is referred to generally by Reference Arrow 1A. In FIG. 2, all reference numerals having a suffix "A" are configured substantially identically to similarly numbered structures appearing in FIG. 1. The alternative 1A implement incorporates propelling means in the form of left and right attachment clevises 78 and 80 which are adapted and positioned for attachment to the lift arms and bucket rams of a skid steer loader (not depicted in views) or, of a front end loader tractor (not depicted within views). Alternatively, the rear of the implement may be adapted to present an upper lateral flange and lower pawl slots for releasable engagement with a skid steer quick attach system.

In contrast with the propelling means of FIG. 1 which facilitates use of a tractor's three point hitch to pull the implement 1 forwardly over a ground surface 10, the alternative propelling means 78,80 of the FIG. 2 assembly utilizes and attaches to a skid steer loader's lift arms for forwardly driving the implement over the ground.

Figure 3:
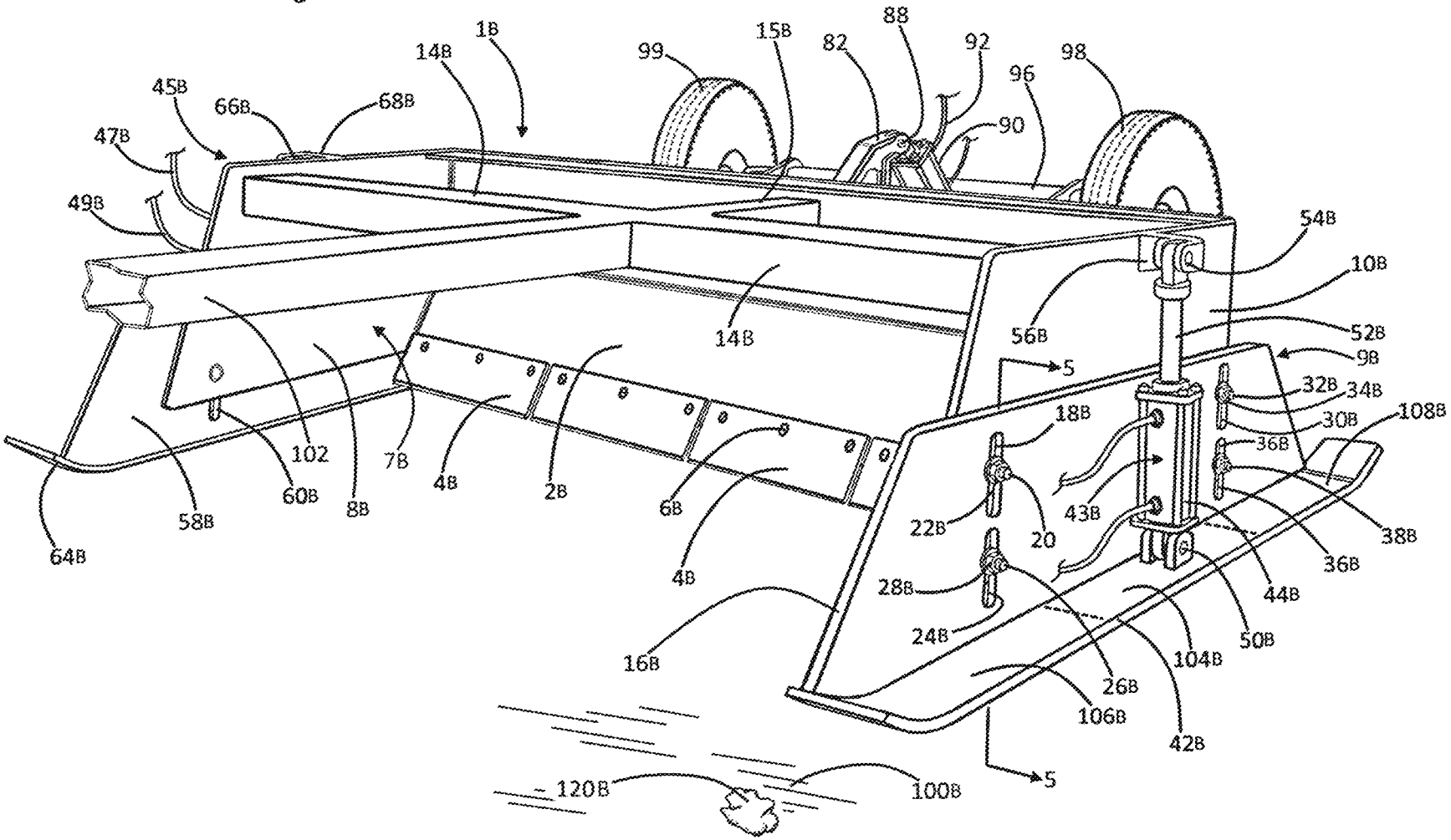
FIG. 3 presents a further alternative configuration of the implement of FIG. 1.
Figure 4:
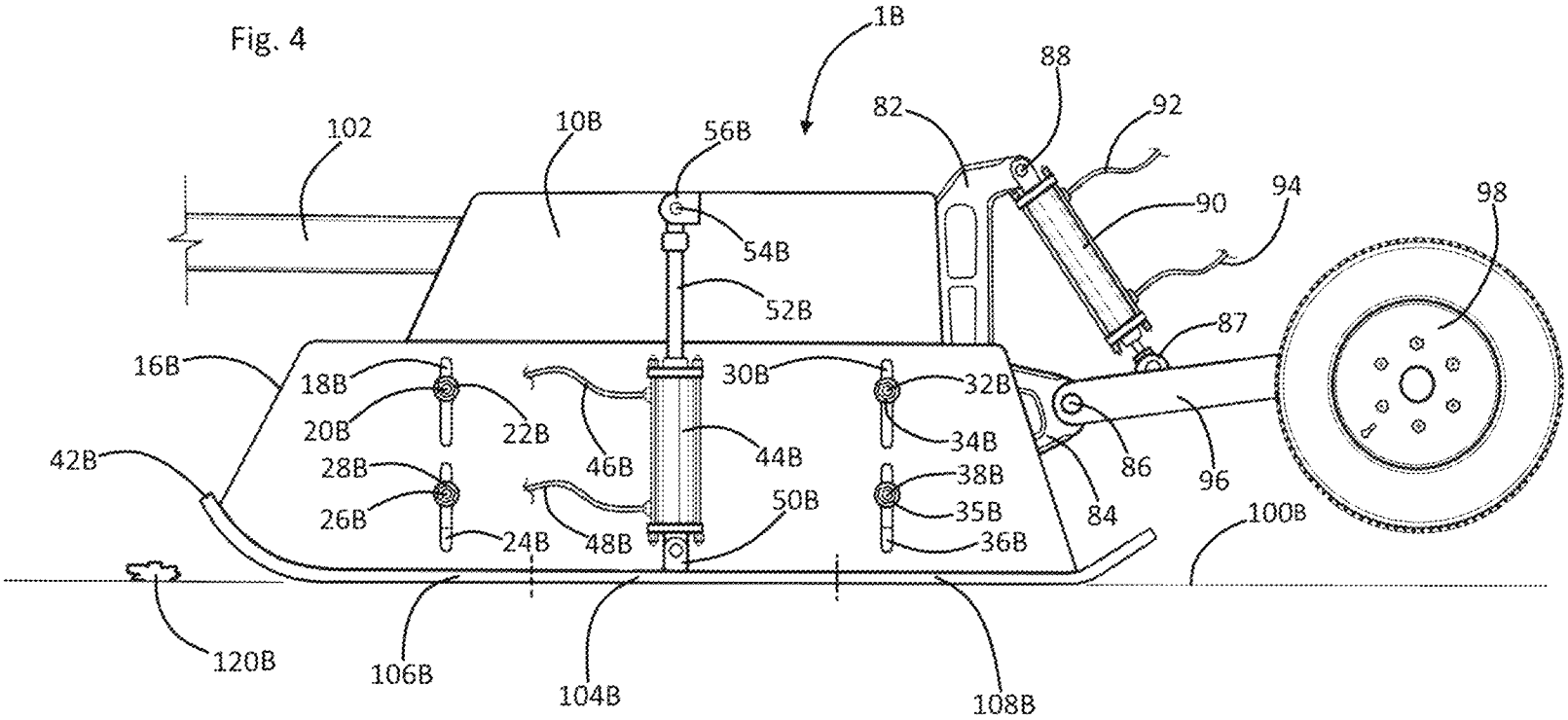
FIG. 4 is a side view of the implement of FIG. 3.

Referring simultaneously to FIGS. 3 and 4, a further alternative box blade earth grading implement is referred to generally by Reference Arrow 1B. Each structure in FIGS. 3 and 4 which is identified by reference numeral having a suffix "B" is configured substantially identically with similarly numbered structures appearing in FIGS. 1 and 2. The alternative propelling means components of the 1B implement comprise a forwardly extending tow tongue 102 in combination with crossbeam 14B, such crossbeam dually functioning as a box structural stiffening member and as a tongue anchoring member. The forward end of the tow tongue 102 preferably includes a common trailer hitch coupler (not depicted within views). In use, a truck or tractor induced pulling force applied to tongue 102 propels the implement 1B forwardly over a ground surface 100B.

The left and right lift arms of a three point hitch (which may attach to clevis mounts 72 and 70 of FIG. 1) and the lift arms of a skid steer loader (which may attach to the rear clevis mounts 78 and 80 of FIG. 2) may effectively raise the entirety of implements 1 or 1A above ground surfaces 100 or 100A, as the case may be. Thus, implements 1 and 1A may be directly raised and lowered by the vehicle to which the implement is attached in order to drop accumulated dirt or to proceed with over-the-road transport of the implement. In contrast, the tongue 102 propelling means of the 1B implement is incapable of raising such implement above ground surface 100B.

To accommodate for such functional incapacity of the tow tongue 102, left and right trailering wheels 98 and 99 may be provided as an integral component of the tow tongue propelling means, such wheels being mounted rotatably upon an axle extension frame 96 whose forward end is pivotably mounted to the implement by a pivot mount 84,86. An upper pivot bracket 82 is preferably rigidly mounted to the rear of the assembly's blade 2B, and a triangulating two way hydraulic cylinder 90 preferably spans between upper and lower pivot mounts 88 and 87. Hydraulic pressure and power provided via pressure lines 92 and 94 may retract cylinder 90 to raise the axle frame 96 and wheels 98,99 to the upper position depicted in FIG. 4. Earth grading may proceed while the wheels 98,99 remain upwardly retracted.

Alternatively, operation of the cylinder 90 to downwardly pivot and extend frame 96 drives wheels 98,99 downwardly against the ground surface 100B, effectively raising the entirety of the implement 1B above the ground surface. The downward extensions of wheels 98,99 against ground surface 100B, allows dirt accumulated within the box to be dropped, and allows the implement 1B to be towed over road surfaces in the manner of a common wheeled trailer.

As can be seen in FIG. 1, lower wall segments 16 and 58 overlap and are respectively positioned immediately leftwardly and rightwardly from the leftward and rightward faces of upper wall segments 10 and 8. In order to prevent the lower wall segments 16 and 58 from splaying leftwardly and rightwardly away from the underlying left and right upper wall segments, left and right pluralities of retainers are preferably provided. As shown in FIG. 1, a preferred configuration of the left plurality of retainers comprises washer and helically threaded nut combinations 22, 28, 34, and 35. Each of such nut and washer configured retainers is preferably mounted upon a helically threaded lug 20, 26, 32, or 38, whose rightward or inner end is rigidly mounted by welds (e.g., welds 62 on opposite upper wall segment 8 such weld aligning with travel slot 60) to wall segment 10. Each such lug's leftward end extends leftwardly through a travel slot 22, 24, 30, or 36 within lower wall 16.

In the above described configuration of the implement's left retainer plurality component, the washer and nut combinations 22,28,34,35 advantageously function as "T" heads which bear against the leftward face of wall segment 16. Impingement of such "T" heads advantageously stops and resists any leftward movement of wall segment 16 away from wall segment 10. A right plurality of retainers is preferably configured similarly with the left plurality 22,28, 34,35, and the depicted left retainer plurality is considered to be representative of other commonly configured mechanical stops which may resist splaying motions of walls such as wall segments 16 and 58.

Figure 5:
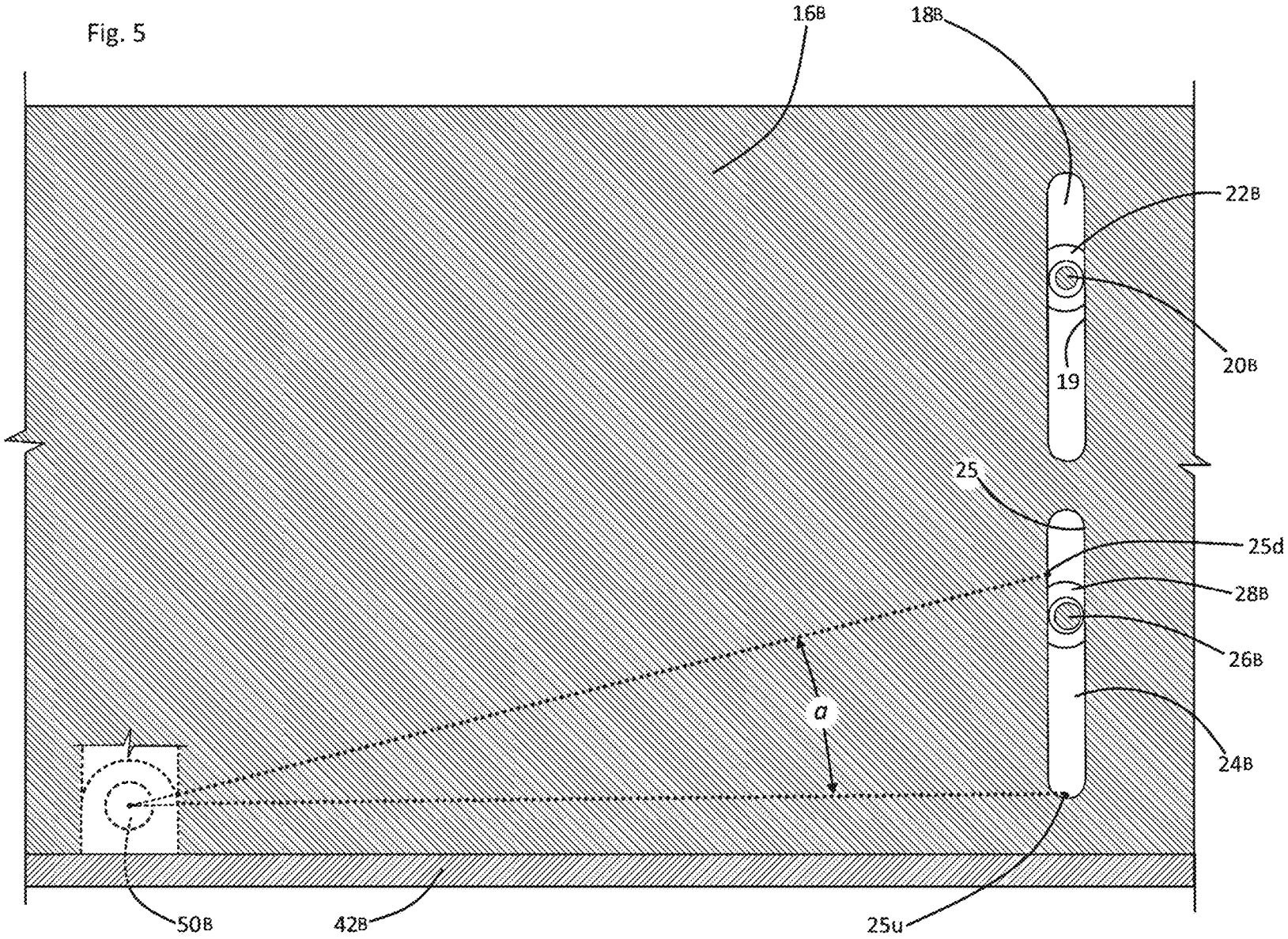
FIG. 5 is a partial sectional view, as indicated in FIG. 1.

In use of the instant inventive assembly, and referring simultaneously to FIGS. 3-5, hydraulic pressure may be initially supplied to hydraulic line 94 (with pressure relief at line 92) to retract hydraulic cylinder 90 and to simultaneously pivot wheels 98,99 and axle frame 96 upwardly to the raised position depicted in FIGS. 3 and 4.

Thereafter, the towing hitch coupler (not depicted within views) at the forward end of tow tongue 102 may be attached to the rear hitch of a tow vehicle such as a truck or tractor (also not depicted within view). Thereafter, the implement's left and right linear motion actuators 43B and 45B may be selectively actuated to situate the lower edges of cutter blades 4B at a desire elevation and angle with respect to a ground surface 100B to be graded. In the event that surface 100B is a gravel or dirt road surface in need of a center crown, the leftward end of such blade segments 4 may be raised slightly relative to the blade's rightward end.

Upon forward pulling of the implement 1B, an obstruction such as a rock 120B may come into impinging contact with the front end of slide skid 42B. Upon such contact, plate 16B and slide skid 42B may temporarily pivot or pitch upwardly, advantageously preventing any exaggerated upward deflection of the leftward end of the blade 2B. Upon rearward passage of such rock 120B beyond the midpoint 104B of the slide skid 42B, such slide skid and lower wall segment 16B may counter-pivot or counter-pitch, allowing the leftward end of the blade to relatively gradually descend to the pre-selected blade orientation and level. Accordingly, the instant inventive implement facilitates pitching and counter-pitching motions of the left and right slide skids 42 and 64 to allow such skids to "walk" over obstructions such as rock 120B without unduly perturbing the orientation of blade 2B.

Referring in particular to FIG. 5, the inner peripheries 25 and 19 of travel slots 24B and 18B advantageously function as rotation stops which limit the above described pitching and counter-pitching motions of the skid plate 42B about pivot mount 50B. Mirroringly configured travel slots within the right lower wall segment 58B similarly function as pitch and counter-pitch motion stops.

As shown in FIG. 5, the longitudinal width of travel slot of 24B exceeds the shaft diameter of lug 26B so that, upon upward pitching of skid 42B and of wall segment 16B about pivot mount 50B, lug 26B may contact the inner periphery 25 of slot 24B at a lower point 25*u*. Upon an immediately successive counter-pitching motion within an angular motion limit "a", contact point 25*a* may similarly stop counter-pitching motions of such skid and plate components. The diameter of threaded lug 20B may be selected so that it is slightly less than that of lug 26B, assuring that slot contact points 25*d* and 25*u* exclusively function as rotation stopping points. Alternatively, the width of slot 18B may be expanded relative to the width of slot 24B. Other lugs and slots of the implement are preferably similarly configured to correspondingly function as rotation stops.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A box blade earth grading implement comprising:

(a) a blade having a lower edge, a left end, and a right end;

(b) a left wall having an upper segment and a lower segment, said upper segment being fixedly attached to the left end of the blade;

(c) a right wall having an upper segment and a lower segment, said upper segment being fixedly attached to the right end of the blade;

(d) left and right skid plates respectively fixedly attached to the left and right walls' lower segments;

(e) left and right linear motion actuators having upper and lower ends;

(f) left and right upper mounts respectively rigidly positioning the upper ends of the left and right linear motion actuators upwardly from the left and right walls' lower segments;

(g) a left pivot mount fixedly attaching the lower end of the left linear motion actuator to the left skid plate;

(h) a right pivot mount fixedly attaching the lower end of the right linear motion actuator to the right skid plate; and (i) propelling means fixedly attached to a structure selected from the group consisting of the blade, the left wall's upper segment, and the right wall's upper segment, said means being adapted for joining with a vehicle auxiliary implement connector, wherein each of the skid plates has a medial section, wherein each of the pivot mounts is positioned at one of said medial sections, wherein the left and right walls' lower segments are respectively positioned leftwardly and rightwardly from said walls' upper segments.

2. The box blade earth grading implement of claim 1 further comprising left and right pluralities of retainers respectively fixedly mounted upon the left and right walls' upper segments, said retainer pluralities respectively operatively engaging said walls' lower segments for resisting respective left and right lower segment movements.

3. The box blade earth grading implement of claim 2 comprising left and right pluralities of rotation stops respectively fixedly mounted upon the left and right walls' upper segments, said rotation stop pluralities respectively operatively engaging said walls' lower segments for limiting lower segment pitch and counterpitch movements.

4. The box blade earth grading implement of claim 3 comprising left and right pluralities of "T" pin and travel slot combinations, each of said combinations' travel slots opening at one of the left and right walls' lower segments, and each of said combinations' "T" pins extending through one of said travel slots to anchor upon one of the left and right walls' upper segments.

5. The box blade earth grading implement of claim 4 wherein each pin among the left and right pluralities of "T" pins has an enlarged head, and wherein the left and right pluralities of retainers comprise said enlarged heads.

6. The box blade earth grading implement of claim 5 wherein each "T" pin comprises a helically threaded lug, and wherein each of the "T" pins enlarged heads comprises a helically threaded nut.

7. The box blade earth grading implement of claim 6 wherein each slot among the left and right pluralities of travel slots has a peripheral edge, and wherein the left and right pluralities of rotation stops comprise said peripheral edges.

8. The box blade earth grading implement of claim 1 wherein the left and right linear motion actuators comprise two way hydraulic cylinders.

9. A box blade earth grading implement comprising:

(a) a blade having a lower edge, a left end, and a right end;

(b) a left wall having an upper segment and a lower segment, said upper segment being fixedly attached to the left end of the blade;

(c) a right wall having an upper segment and a lower segment, said upper segment being fixedly attached to the right end of the blade;

(d) left and right skid plates respectively fixedly attached to the left and right walls' lower segments;

(e) left and right linear motion actuators having upper and lower ends, said actuators comprising two way hydraulic cylinders;

(f) left and right upper mounts respectively rigidly positioning the upper ends of the left and right linear motion actuators upwardly from the left and right walls' lower segments;

(g) a left pivot mount fixedly attaching the lower end of the left linear motion actuator to a structure selected from the group consisting of the left wall's lower segment and the left skid plate;

(h) a right pivot mount fixedly attaching the lower end of the right linear motion actuator to a structure selected from the group consisting of the right wall's lower segment and the right skid plate;

(i) propelling means fixedly attached to a structure selected from the group consisting of the blade, the left wall's upper segment, and the right wall's upper segment, said means being adapted for joining with a vehicle auxiliary implement connector, and (j) a crossbeam spanning between the left and right walls' upper segments, the propelling means comprising said crossbeam.

10. The box blade earth grading implement of claim 9 wherein the propelling means comprise a towing tongue extending forwardly from the crossbeam.

11. The box blade earth grading implement of claim 10 wherein the propelling means comprise left and right trailering wheels operatively positioned rearwardly from the blade.

12. The box blade earth grading implement of claim 11 further comprising a pivot arm and hydraulic cylinder combination, said combination's pivot arm extending rearwardly from the blade, said combination being adapted for, upon an actuation of said combination's hydraulic cylinder, pivoting the left and right trailering wheels downwardly against the earth for raising the blade.

* * * * *